US009747869B2

(12) United States Patent
Ko et al.

(10) Patent No.: US 9,747,869 B2
(45) Date of Patent: Aug. 29, 2017

(54) DRIVING METHOD FOR DISPLAY PANEL

(71) Applicant: AU OPTRONICS CORP., Hsin-Chu (TW)

(72) Inventors: Chien-Chuan Ko, Hsin-Chu (TW); Meng-Chieh Tsai, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 169 days.

(21) Appl. No.: 14/449,496

(22) Filed: Aug. 1, 2014

(65) Prior Publication Data

US 2015/0340011 A1 Nov. 26, 2015

(30) Foreign Application Priority Data

May 23, 2014 (TW) ..... 103118099 A

(51) Int. Cl.
*G09G 5/00* (2006.01)
*G09G 5/18* (2006.01)
*G09G 3/20* (2006.01)

(52) U.S. Cl.
CPC ..... *G09G 5/18* (2013.01); *G09G 3/20* (2013.01); *G09G 2310/0224* (2013.01); *G09G 2310/0283* (2013.01); *G09G 2310/0286* (2013.01); *G09G 2320/0219* (2013.01); *G09G 2320/0673* (2013.01)

(58) Field of Classification Search
CPC .... G09G 3/20; G09G 5/18; G09G 2310/0224; G09G 2310/0283; G09G 2310/0286; G09G 2320/0219; G09G 2320/0673
USPC ..... 345/211, 212, 205, 204, 87, 104, 88, 89, 345/90, 91, 92, 93, 94, 95, 96, 97, 98, 99, 345/100, 101, 102, 103
See application file for complete search history.

(56) References Cited

U.S. PATENT DOCUMENTS

| | | | | |
|---|---|---|---|---|
| 9,203,395 | B2 * | 12/2015 | Kim | G09G 3/3677 |
| 2009/0086116 | A1 * | 4/2009 | Pak | G09G 3/3655 349/38 |
| 2009/0256833 | A1 * | 10/2009 | Huang | G09G 3/20 345/213 |
| 2010/0141643 | A1 | 6/2010 | Li et al. | |
| 2011/0175878 | A1 | 7/2011 | Hsiao et al. | |
| 2011/0193833 | A1 | 8/2011 | Hsu et al. | |
| 2012/0105425 | A1 * | 5/2012 | Sasanuma | G09G 3/3655 345/212 |
| 2013/0088470 | A1 | 4/2013 | Chang et al. | |

* cited by examiner

*Primary Examiner* — Nelson Rosario
(74) *Attorney, Agent, or Firm* — WPAT, PC

(57) ABSTRACT

A driving method for a display panel is disclosed. The display panel includes a plurality of gate lines. The driving method includes: driving the plurality of gate lines in a first preset sequence and a second preset sequence by turns, wherein the first preset sequence is defined from the first of the plurality of gate lines to the last of the plurality of gate lines, the second preset sequence is defined from the last of the plurality of gate lines to the first of the plurality of gate lines, and driving periods of each two adjacent gate lines partially overlap; and adjusting a voltage difference, between a high-voltage level and a low-voltage level, of each gate pulse provided to the gate lines when the gate lines are driven either in the first sequence or in the second sequence.

16 Claims, 4 Drawing Sheets

DRIVING METHOD FOR DISPLAY PANEL

TECHNICAL FIELD

The present disclosure relates to a driving method for a display panel, and more particularly to a driving method for gate lines of a display panel.

BACKGROUND

For the gate driver circuit used in small-sized display panel, the double-side-and-single-drive structure (that is, two independent gate driver circuits are disposed on two opposite sides of the display panel and for driving the odd-numbered gate lines and even-numbered gate lines, respectively) is usually adopted due to the specific display panel configuration. In addition, a source driver, for providing data voltages to the pixels of the display panel, is disposed either on the top or bottom of the display panel. Specifically, if the source driver circuit is disposed on the top of the display panel, driving the gate lines by the gate driver circuits in a sequence from top to bottom is so-called forward scan; alternatively, driving the gate lines in a sequence from bottom to top is so-called backward scan.

In order to pre-charge the next column of pixels, the timing sequences of the gate pulses provided to each two adjacent gate lines respectively driven by the two gate driver circuits disposed on two opposite sides of the display panel have an overlap design. However, because the gate pulse overlap design, a feed-through voltage may be generated and the data voltage stored in the pixel capacitor may be affected by the generated feed-through voltage when the forward scan or the backward scan is performed. In general, the various-degree effect of the feed-through voltage on the data voltage can be compensated by the adjustment of the voltage difference between the gamma voltage and the common voltage (Vcom). In addition, the feed-through voltage resulted by the backward scan has a greater effect on the data voltage stored in the pixel circuit, compared with the feed-through voltage resulted by the forward scan. Thus, for the compensation of the various effects of the feed-through voltages for both of the forward scan and the backward scan, more numbers of setting value of gamma voltage and common voltage are required. In addition, more tuning time is also required if the gamma voltage and the common voltage have a relatively large degree to be adjusted.

SUMMARY

An object of the present disclosure is to provide a driving method for a display panel. Through the driving method, the display panel can use one same group of gamma voltage and common voltage for compensating the various degrees of effect resulted by the feed-through voltage of either the forward scan or the backward scan.

The present disclosure discloses a driving method for a display panel. The display panel includes a plurality of gate lines. The driving method includes: driving the plurality of gate lines in a first preset sequence and a second preset sequence by turns, wherein the first preset sequence is defined from the first of the plurality of gate lines to the last of the plurality of gate lines, the second preset sequence is defined from the last of the plurality of gate lines to the first of the plurality of gate lines, and driving periods of each two adjacent gate lines partially overlap; and adjusting a voltage difference, between a high-voltage level and a low-voltage level, of each gate pulse provided to the gate lines when the gate lines are driven either in the first sequence or in the second sequence.

In summary, through increasing the feed-through voltage resulted by the gate lines operated in the forward scan and decreasing the feed-through voltage resulted by the gate lines operated in the backward scan, the display panel and the driving method thereof can use one same group of gamma voltage and common voltage.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
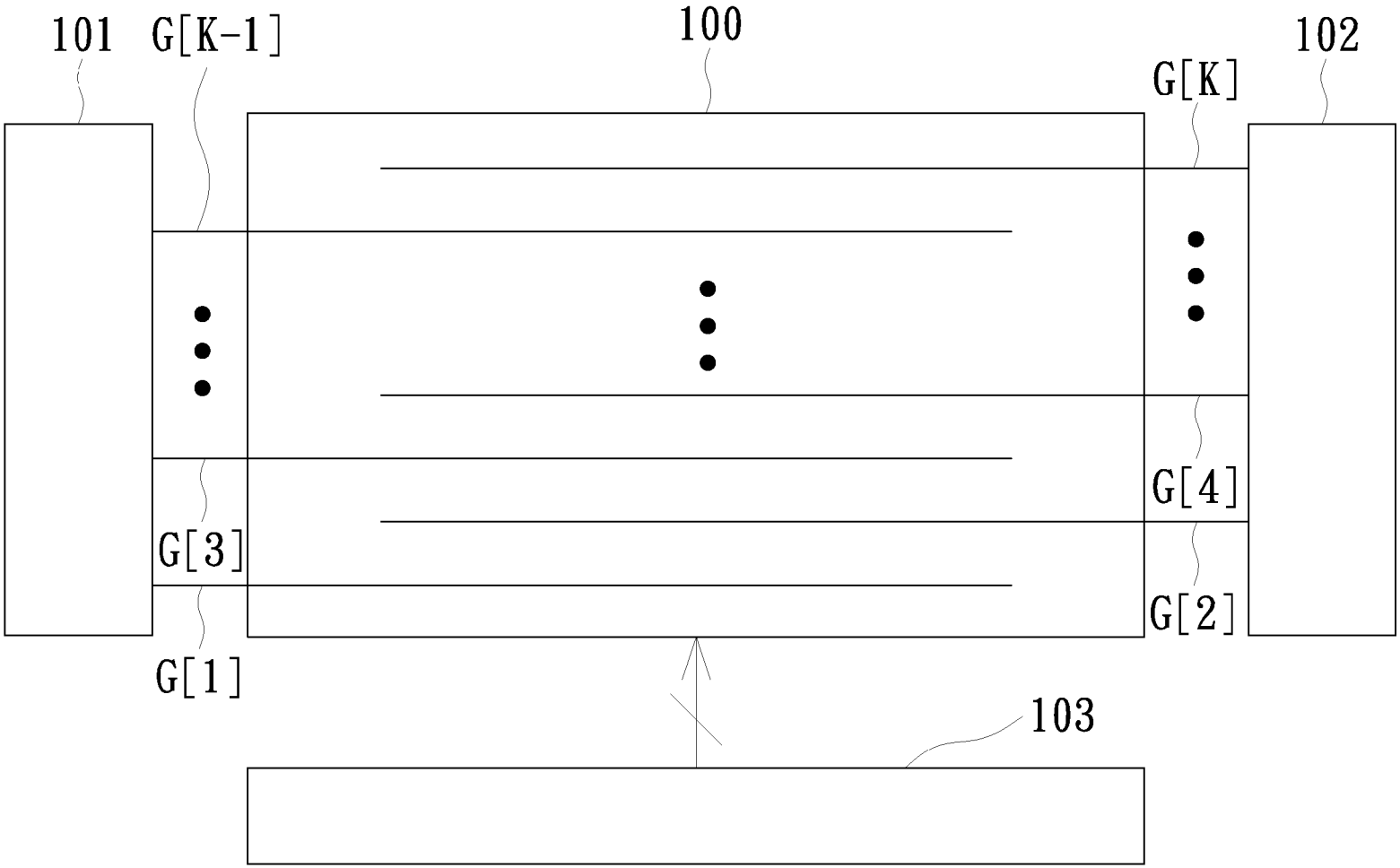
FIG. 1 is a schematic view of a gate line configuration of a display panel in accordance with an embodiment of the present disclosure.

FIG. 1 is a schematic view of a gate line configuration of a display panel in accordance with an embodiment of the present disclosure. As shown, the display panel 100 in the present embodiment includes a plurality of odd-numbered gate lines G[1], G[3] . . . G[K−1] and a plurality of even-numbered gate lines G[2], G[4] . . . G[K]. The odd-numbered gate lines G[1], G[3] . . . G[K−1] are electrically coupled to a gate driver circuit 101 and the even-numbered gate lines G[2], G[4] . . . G[K] are electrically coupled to a gate driver circuit 102. The odd-numbered gate lines G[1], G[3] . . . G[K−1] and the even-numbered gate lines G[2], G[4] . . . G[K] have an alternating arrangement; that is, the gate lines G[1], G[2] . . . G[K−1], G[K] are arranged in a sequence from bottom to top of the display panel 100. The gate driver circuits 101, 102 are disposed on two opposite sides of the display panel 100. The display panel 100 is further electrically coupled to a source driver circuit 103 which is disposed under the display panel 100. Specifically, driving the gate lines G[1], G[2] . . . G[K−1], G[K] in a sequence from top to bottom (that is, from the farthest end of the display panel 100 relative to the source driver circuit 103 to the nearest end of the display panel 100 relative to the source driver circuit 103) is so-called forward scan; and driving the gate lines G[1], G[2] . . . G[K−1], G[K] in a sequence from bottom to top (that is, from the nearest end of the display panel 100 relative to the source driver circuit 103 to the farthest end of the display panel 100 relative to the source driver circuit 103) is so-called backward scan.

Figure 2A:
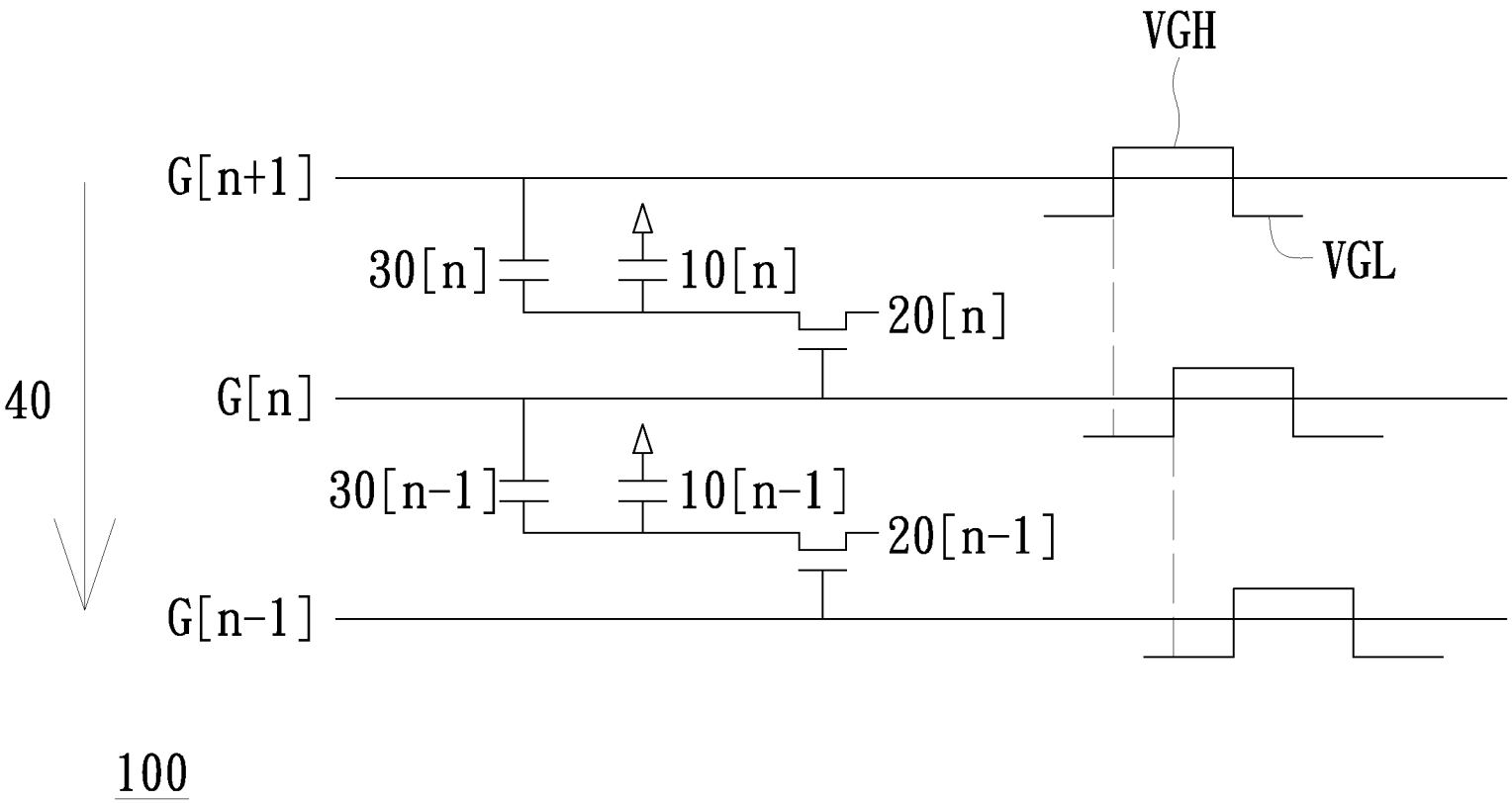
FIG. 2A is a schematic view illustrating the timing sequence of gate signals and respective pixels circuits of a forward-scan display panel in accordance with an embodiment of the present disclosure.

FIG. 2A is a schematic view illustrating the timing sequence of gate signals and respective pixels circuits of the forward-scan display panel 100 in accordance with an embodiment of the present disclosure. To facilitate a better understanding of the present disclosure, it is to be noted that the display panel 100 in FIG. 2A is exemplified by including three gate lines G[n+1], G[n] and G[n−1] only and the rest of gate lines shown in FIG. 1 is omitted for brevity. As shown in 2A, each pixel circuit includes a pixel capacitor 10[$n$−1], 10[$n$] and a transistor 20[$n$−1], 20[$n$]. Specifically, each pixel circuit is electrically coupled to a respective gate line through the transistor thereof. In addition, a parasitic capacitor is formed between one terminal of the respective pixel capacitor and one respective gate line. As illustrated in FIG. 2A, for example, a parasitic capacitor 30[$n$−1] is formed between one terminal of the pixel capacitor 10[$n$−1] and the gate line G[n]; and a parasitic capacitor 30[$n$] is formed between one terminal of the pixel capacitor 10[$n$] and the gate line G[n+1].

As shown in FIG. 2A, when the gate lines G[n+1], G[n] and G[n−1] are driven by the display panel 100 by way of forward scan (that is, driven in a sequence indicated by the arrow 40) thereby providing the respective gate pulses to the respective pixel circuits, the gate pulses on each two adjacent gate lines partially overlap. Specifically, the gate pulse transmitted by the gate line G[n+1] has a phase lead relative to the phase of the gate pulse transmitted by the gate line G[n]; and the gate pulse transmitted by the gate line G[n] has a phase lead relative to the phase of the gate pulse transmitted by the gate line G[n−1]. According to the aforementioned signal configuration, it is to be noted that the gate line G[n] still transmits the respective gate pulse when the gate line G[n+1] stops transmitting the respective gate pulse. Thus, the voltage on the gate line G[n+1] may be coupled to the pixel capacitor 10[$n$] by the gate pulse on the gate line G[n+1] through the parasitic capacitor 30[$n$] thereby generating a feed-through voltage; and consequentially the data voltage stored in the pixel capacitor 10[$n$] may be affected by the feed-through voltage. However, it is to be noted that the effect of the aforementioned feed-through voltage on the data voltage stored in the pixel capacitor 10[$n$] is stop once the gate line G[n+1] stops transmitting the respective gate pulse and the gate line G[n] still transmits the respective gate pulse. Based on the same manner, it is understood that data voltage stored in the pixel capacitor 10[$n$−1] is neither affected by the corresponding feed-through voltage when the gate line G[n] stops transmitting the respective gate pulse but the gate line G[n−1] still transmits the respective gate pulse.

Figure 2B:
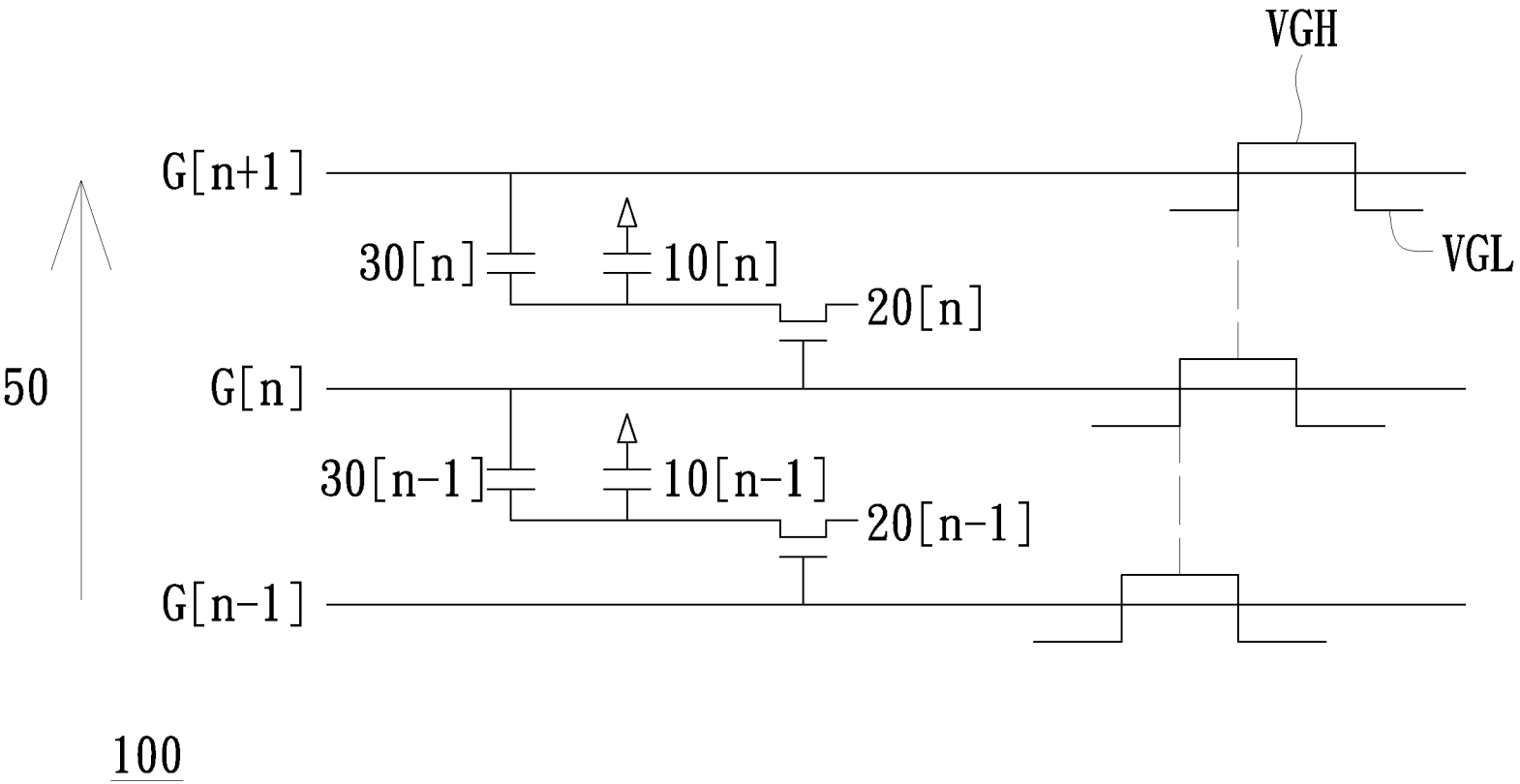
FIG. 2B is a schematic view illustrating the timing sequence of gate signals and respective pixels circuits of a backward-scan display panel in accordance with an embodiment of the present disclosure.

FIG. 2B is a schematic view illustrating the timing sequence of gate signals and respective pixels circuits of the backward-scan display panel 100 in accordance with an embodiment of the present disclosure. As shown, when the gate lines G[n+1], G[n] and G[n−1] are driven by the display panel 100 by way of backward scan (that is, driven in a sequence indicated by the arrow 50) thereby providing the respective gate pulses to the respective pixel circuits, the gate pulses on each two adjacent gate lines partially overlap. Specifically, the gate pulse transmitted by the gate line G[n−1] has a phase lead relative to the phase of the gate pulse transmitted by the gate line G[n]; and the gate pulse transmitted by the gate line G[n] has a phase lead relative to the phase of the gate pulse transmitted by the gate line G[n+1]. According to the aforementioned signal configuration, it is to be noted that the gate line G[n] still transmits the respective gate pulse when the gate line G[n−1] stops transmitting the respective gate pulse. Thus, the voltage on the gate line G[n] may be coupled to the pixel capacitor 10[$n$−1] by the gate pulse on the gate line G[n] through the capacitor 30[$n$−1] thereby generating a feed-through voltage; and consequentially the data voltage stored in the pixel capacitor 10[$n$−1] may be affected by the feed-through voltage. Based on the same manner, it is understood that data voltage stored in the pixel capacitor 10[$n$] is also affected by the corresponding feed-through voltage when the gate line G[n] stops transmitting the respective gate pulse but the gate line G[n+1] still transmits the respective gate pulse.

According to the above description, it is to be noted that the feed-through voltage resulted by the backward scan has a greater effect on the data voltage stored in the pixel circuit, compared with the feed-through voltage resulted by the forward scan. Thus, more numbers of setting value of gamma voltage (Gamma) and common voltage (Vcom) are required for the compensation of the various effects of the feed-through voltages.

The object of compensating the effects of the feed-through voltage by using one same setting value of gamma voltage and common voltage for both of the forward scan and backward scan can be realized by the adjustment of the high-voltage level VGH and the low-voltage level VGL of gate pulse; the detail will be described as follow. In one embodiment the present disclosure, the high-voltage level VGH is preset to 15V and the low-voltage level VGL is preset to −12V; and the two have a voltage difference 27V. In the present disclosure, the object of using the same group of gamma voltage and common voltage for both of the forward scan and backward scan can be realized by either increasing the voltage difference between the high-voltage level VGH and the low-voltage level VGL thereby increasing the feed-through voltage when the forward scan is performed or decreasing the voltage difference thereby decreasing the feed-through voltage when the backward scan is performed. The detail of the adjustments of the high-voltage level VGH and the low-voltage level VGL will be described later. Specifically, it is to be noted that the setting value of the gamma voltage and the common voltage in the present disclosure is represented by a three-digit hexadecimal code; in other words, each three-digit code represents one gamma voltage value and one corresponding common voltage value.

In a first embodiment, when the forward scan is performed, the increase of the voltage difference between the high-voltage level VGH and the low-voltage level VGL thereby increasing the feed-through voltage is realized by way of increasing the high-voltage level VGH of each gate pulse on each one of the gate lines G[n+1], G[n] and G[n−1]. As illustrated in Table 1, for example, the high-voltage level VGH of gate pulse is adjusted from the preset value 15V to 18V and the low-voltage level VGL is maintained to the preset value −12V, thereby increasing the voltage difference between the high-voltage level VGH and the low-voltage level VGL from 27V to 30V. Consequentially, the common voltage of the forward scan and the common voltage of the backward scan are pulled closer or even equal to each other. For example, as shown in Table 1, the setting value of the gamma voltage and common voltage adopted in the forward scan is adjusted from the preset value 63 H to 6 EH and the setting value of the gamma voltage and common voltage adopted in the backward scan is adjusted from the preset value 6 FH to 6 EH. As a result, the setting value of the gamma voltage and common voltage when the forward scan is performed is equal to that when the backward scan is performed (both are 6 EH); and consequentially, the tuning time for the adjustments of the setting values of the gamma voltage and common voltage in the transition between the forward scan and the backward scan is effectively reduced.

TABLE 1

| | Preset value (voltage difference 27 V) | Increase voltage difference (30 V) |
|---|---|---|
| VGH | 15 V | 18 V |
| VGL | −12 V | −12 V |
| Setting value of gamma voltage and common voltage (forward scan) | 63H | 6EH |
| Setting value of gamma voltage and common voltage (backward scan) | 6FH | 6EH |

In a second embodiment, when the backward scan is performed, the decrease of the voltage difference between the high-voltage level VGH and the low-voltage level VGL thereby decreasing the feed-through voltage is realized by way of decreasing the high-voltage level VGH of each gate pulse on each one of the gate lines G[n+1], G[n] and G[n−1]. As illustrated in Table 2, for example, the high-voltage level VGH of gate pulse is adjusted from the preset value 15V to 12V and the low-voltage level VGL is maintained to the preset value −12V, thereby decreasing the voltage difference between the high-voltage level VGH and the low-voltage level VGL from 27V to 24V. Consequentially, the common voltage of the forward scan and the common voltage of the backward scan are pulled closer or even equal to each other. For example, as shown in Table 2, the setting value of the gamma voltage and common voltage adopted in the backward scan is adjusted from the preset value 6 FH to 63 H and the setting value of the gamma voltage and common voltage adopted in the forward scan is maintained to the preset value 63 H. As a result, the setting value of the gamma voltage and common voltage when the forward scan is performed is equal to that when the backward scan is performed (both are 63 H); and consequentially, the tuning time for the adjustments of the setting values of the gamma voltage and common voltage in the transition between the forward scan and the backward scan is effectively reduced.

TABLE 2

| | Preset value (voltage difference 27 V) | Decrease voltage difference (24 V) |
|---|---|---|
| VGH | 15 V | 12 V |
| VGL | −12 V | −12 V |
| Setting value of gamma voltage and common voltage (forward scan) | 63H | 63H |
| Setting value of gamma voltage and common voltage (backward scan) | 6FH | 63H |

In a third embodiment, when the forward scan is performed, the increase of the voltage difference between the high-voltage level VGH and the low-voltage level VGL thereby increasing the feed-through voltage is realized by way of decreasing the low-voltage level VGL of each gate pulse on each one of the gate lines G[n+1], G[n] and G[n−1]. As illustrated in Table 3, for example, the low-voltage level VGL of gate pulse is adjusted from the preset value −12V to −15V and the high-voltage level VGH is maintained to the preset value 15V, thereby increasing the voltage difference between the high-voltage level VGH and the low-voltage level VGL from 27V to 30V. Consequentially, the common voltage of the forward scan and the common voltage of the backward scan are pulled closer or even equal to each other. For example, as shown in Table 3, the setting value of the gamma voltage and common voltage adopted in the forward scan is adjusted from the preset value 63 H to 6 EH and the setting value of the gamma voltage and common voltage adopted in the backward scan is adjusted from the preset value 6 FH to 6 EH. As a result, the setting value of the gamma voltage and common voltage when the forward scan is performed is equal to that when the backward scan is performed (both are 6 EH); and consequentially, the tuning time for the adjustments of the setting values of the gamma voltage and common voltage in the transition between the forward scan and the backward scan is effectively reduced.

TABLE 3

| | Preset value (voltage difference 27 V) | Increase voltage difference (30 V) |
|---|---|---|
| VGH | 15 V | 15 V |
| VGL | −12 V | −15 V |
| Setting value of gamma voltage and common voltage (forward scan) | 63H | 6EH |
| Setting value of gamma voltage and common voltage (backward scan) | 6FH | 6EH |

In a fourth embodiment, when the backward scan is performed, the decrease of the voltage difference between the high-voltage level VGH and the low-voltage level VGL thereby decreasing the feed-through voltage is realized by way of increasing the low-voltage level VGL of each gate pulse on each one of the gate lines G[n+1], G[n] and G[n−1]. As illustrated in Table 4, for example, the low-voltage level VGL of gate pulse is adjusted from the preset value −12V to −9V and the high-voltage level VGH is maintained to the preset value 15V, thereby decreasing the voltage difference between the high-voltage level VGH and the low-voltage level VGL from 27V to 24V. Consequentially, the common voltage of the forward scan and the common voltage of the backward scan are pulled closer or even equal to each other. For example, as shown in Table 4, the setting value of the gamma voltage and common voltage adopted in the backward scan is adjusted from the preset value 6 FH to 63 H and the setting value of the gamma voltage and common voltage adopted in the forward scan is maintained to the preset value 63 H. As a result, the setting value of the gamma voltage and common voltage when the forward scan is performed is equal to that when the backward scan is performed (both are 63 H); and consequentially, the tuning time for the adjustments of the setting values of the gamma voltage and common voltage in the transition between the forward scan and the backward scan is effectively reduced.

TABLE 4

| | Preset value (voltage difference 27 V) | Decrease voltage difference (24 V) |
|---|---|---|
| VGH | 15 V | 15 V |
| VGL | −12 V | −9 V |
| Setting value of gamma voltage and common voltage (forward scan) | 63H | 63H |
| Setting value of gamma voltage and common voltage (backward scan) | 6FH | 63H |

In a fifth embodiment, when the forward scan is performed, the increase of the voltage difference between the high-voltage level VGH and the low-voltage level VGL thereby increasing the feed-through voltage is realized by way of increasing the high-voltage level VGH as well as decreasing the low-voltage level VGL of each gate pulse on each one of the gate lines G[n+1], G[n] and G[n−1]. As illustrated in Table 5, for example, the high-voltage level VGH of gate pulse is adjusted from the preset value 15V to 16.5V and the low-voltage level VGL of gate pulse is adjusted from the preset value −12V to −13.5V, thereby increasing the voltage difference between the high-voltage level VGH and the low-voltage level VGL from 27V to 30V. Consequentially, the common voltage of the forward scan and the common voltage of the backward scan are pulled closer or even equal to each other. For example, as shown in Table 5, the setting value of the gamma voltage and common voltage adopted in the forward scan is adjusted from the preset value 63 H to 6 EH and the setting value of the gamma voltage and common voltage adopted in the backward scan is adjusted from the preset value 6 FH to 6 EH. As a result, the setting value of the gamma voltage and common voltage when the forward scan is performed is equal to that when the backward scan is performed (both are 6 EH); and consequentially, the tuning time for the adjustments of the setting values of the gamma voltage and common voltage in the transition between the forward scan and the backward scan is effectively reduced.

TABLE 5

| | Preset value (voltage difference 27 V) | Increase voltage difference (30 V) |
|---|---|---|
| VGH | 15 V | 16.5 V |
| VGL | −12V | −13.5 V |
| Setting value of gamma voltage and common voltage (forward scan) | 63H | 6EH |
| Setting value of gamma voltage and common voltage (backward scan) | 6FH | 6EH |

In a sixth embodiment, when the backward scan is performed, the decrease of the voltage difference between the high-voltage level VGH and the low-voltage level VGL thereby decreasing the feed-through voltage is realized by way of decreasing the high-voltage level VGH as well as increasing the low-voltage level VGL of each gate pulse on each one of the gate lines G[n+1], G[n] and G[n−1]. As illustrated in Table 6, for example, the high-voltage level VGH of gate pulse is adjusted from the preset value 15V to 13.5V and the low-voltage level VGL of gate pulse is adjusted from the preset value −12V to −10.5V, thereby decreasing the voltage difference between the high-voltage level VGH and the low-voltage level VGL from 27V to 24V. Consequentially, the common voltage of the forward scan and the common voltage of the backward scan are pulled closer or even equal to each other. For example, as shown in Table 6, the setting value of the gamma voltage and common voltage adopted in the backward scan is adjusted from the preset value 6 FH to 63 H and the setting value of the gamma voltage and common voltage adopted in the forward scan is maintained to the preset value 63 H. As a result, the setting value of the gamma voltage and common voltage when the forward scan is performed is equal to that when the backward scan is performed (both are 63 H); and consequentially, the tuning time for the adjustments of the setting values of the gamma voltage and common voltage in the transition between the forward scan and the backward scan is effectively reduced.

TABLE 6

| | Preset value (voltage difference 27 V) | Decrease voltage difference (24 V) |
|---|---|---|
| VGH | 15 V | 13.5 V |
| VGL | −12 V | −10.5 V |
| Setting value of gamma voltage and common voltage (forward scan) | 63H | 63H |
| Setting value of gamma voltage and common voltage (backward scan) | 6FH | 63H |

Figure 3:
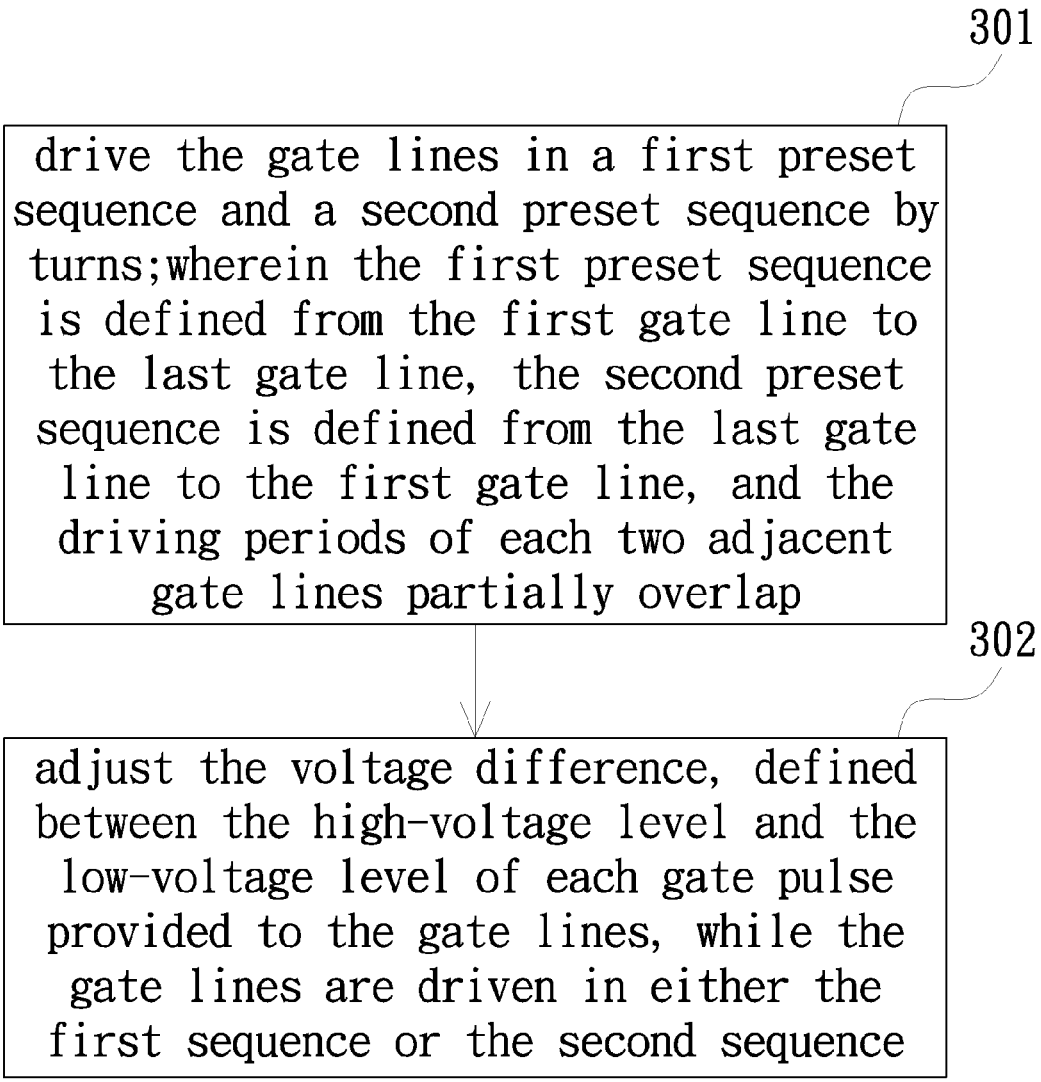
FIG. 3 is a flow chart illustrating a driving method of a display panel in accordance with an embodiment of the present disclosure.

FIG. 3 is a flow chart illustrating a driving method of the display panel 100 in accordance with an embodiment of the present disclosure. As shown, the driving method includes steps 301, 302 as described as follow. First, the gate lines of the display panels 100 are driven in a first preset sequence and a second preset sequence by turns; wherein the first preset sequence is defined from the first gate line to the last gate line, the second preset sequence is defined from the last gate line to the first gate line, and the driving periods of each two adjacent gate lines partially overlap (step 301). Then, the voltage difference, defined between the high-voltage level and the low-voltage level of each gate pulse provided to the gate lines, is adjusted when the gate lines are driven either in the first sequence or in the second sequence (step S302).

In summary, through increasing the feed-through voltage resulted by the gate lines operated in the forward scan and decreasing the feed-through voltage resulted by the gate lines operated in the backward scan, the display panel and the driving method thereof can use one same group of gamma voltage and common voltage.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A driving method for a display panel, the display panel comprising a plurality of gate lines, the driving method comprising:

driving the plurality of gate lines in a first preset sequence and a second preset sequence by turns, wherein the first preset sequence is defined from the first of the plurality of gate lines to the last of the plurality of gate lines, and the second preset sequence is defined from the last of the plurality of gate lines to the first of the plurality of gate lines; and providing a first voltage difference to the gate lines when the gate lines are driven in the first preset sequence and providing a second voltage difference to the gate lines when the gate lines are driven in the second preset sequence, wherein, the first voltage difference and the second voltage difference are a voltage difference between a high-voltage level and a low-voltage level of each gate pulse, and the first voltage difference is greater than the second voltage difference.

2. The driving method according to claim 1, wherein when the gate lines are driven in the first preset sequence, the adjustment of the voltage difference between the high-voltage level and the low-voltage level is realized by increasing the high-voltage level of each gate pulse provided to the gate lines.

3. The driving method according to claim 1, wherein when the gate lines are driven in the second preset sequence, the adjustment of the voltage difference between the high-voltage level and the low-voltage level is realized by decreasing the high-voltage level of each gate pulse provided to the gate lines.

4. The driving method according to claim 1, wherein when the gate lines are driven in the first preset sequence, the adjustment of the voltage difference between the high-voltage level and the low-voltage level is realized by decreasing the low-voltage level of each gate pulse provided to the gate lines.

5. The driving method according to claim 1, wherein when the gate lines are driven in the second preset sequence, the adjustment of the voltage difference between the high-voltage level and the low-voltage level is realized by increasing the low-voltage level of each gate pulse provided to the gate lines.

6. The driving method according to claim 1, wherein when the gate lines are driven in the first preset sequence, the adjustment of the voltage difference between the high-voltage level and the low-voltage level is realized by increasing the high-voltage level of each gate pulse provided to the gate lines as well as decreasing the low-voltage level of each gate pulse provided to the gate lines.

7. The driving method according to claim 1, wherein when the gate lines are driven in the second preset sequence, the adjustment of the voltage difference between the high-voltage level and the low-voltage level is realized by decreasing the high-voltage level of each gate pulse provided to the gate lines as well as increasing the low-voltage level of each gate pulse provided to the gate lines.

8. The driving method according to claim 1, wherein the odd-numbered of the plurality of gate lines are electrically coupled to a first gate driver circuit and the even-numbered of the plurality of gate lines are electrically coupled to a second gate driver circuit, the odd-numbered gate lines and the even-numbered gate lines have an alternating arrangement, the first gate driver circuit and the second gate driver are disposed on two opposite sides of the display panel.

9. A driving method for a display panel, the display panel comprising a plurality of gate lines, the driving method comprising:

driving the plurality of gate lines in a first preset sequence and a second preset sequence by turns, wherein the first preset sequence is defined from the first of the plurality of gate lines to the last of the plurality of gate lines, the second preset sequence is defined from the last of the plurality of gate lines to the first of the plurality of gate lines, and driving periods of each two adjacent gate lines partially overlap; and providing a first voltage difference to the gate lines when the gate lines are driven in the first preset sequence and providing a second voltage difference to the gate lines when the gate lines are driven in the second preset sequence, wherein, the first voltage difference and the second voltage difference are a voltage difference between a high-voltage level and a low-voltage level of each gate pulse, and the first voltage difference is greater than the second voltage difference; and providing one same setting value of gamma voltage to a source driver during driving the gate lines in the first preset sequence and the second preset sequence, and providing one same setting value of common voltage to the display panel during driving the gate lines in the first preset sequence and the second preset sequence.

10. The driving method according to claim 9, wherein when the gate lines are driven in the first preset sequence, the adjustment of the voltage difference between the high-voltage level and the low-voltage level of each gate pulse is realized by increasing the high-voltage level of each gate pulse provided to the gate lines.

11. The driving method according to claim 9, wherein when the gate lines are driven in the second preset sequence, the adjustment of the voltage difference between the high-voltage level and the low-voltage level of each gate pulse is realized by decreasing the high-voltage level of each gate pulse provided to the gate lines.

12. The driving method according to claim 9, wherein when the gate lines are driven in the first preset sequence, the adjustment of the voltage difference between the high-voltage level and the low-voltage level of each gate pulse is realized by decreasing the low-voltage level of each gate pulse provided to the gate lines.

13. The driving method according to claim 9, wherein when the gate lines are driven in the second preset sequence, the adjustment of the voltage difference between the high-voltage level and the low-voltage level of each gate pulse is realized by increasing the low-voltage level of each gate pulse provided to the gate lines.

14. The driving method according to claim 9, wherein when the gate lines are driven in the first preset sequence, the adjustment of the voltage difference between the high-voltage level and the low-voltage level of each gate pulse is realized by increasing the high-voltage level of each gate pulse provided to the gate lines as well as decreasing the low-voltage level of each gate pulse provided to the gate lines.

15. The driving method according to claim 9, wherein when the gate lines are driven in the second preset sequence, the adjustment of the voltage difference between the high-voltage level and the low-voltage level of each gate pulse is realized by decreasing the high-voltage level of each gate pulse provided to the gate lines as well as increasing the low-voltage level of each gate pulse provided to the gate lines.

16. The driving method according to claim 9, wherein the odd-numbered of the plurality of gate lines are electrically coupled to a first gate driver circuit and the even-numbered of the plurality of gate lines are electrically coupled to a second gate driver circuit, the odd-numbered gate lines and the even-numbered gate lines have an alternating arrangement, the first gate driver circuit and the second gate driver are disposed on two opposite sides of the display panel.

* * * * *